US009249682B2

(12) United States Patent
Yoshida et al.

(10) Patent No.: US 9,249,682 B2
(45) Date of Patent: Feb. 2, 2016

(54) STEAM TURBINE POWER PLANT

(71) Applicant: Hitachi, Ltd., Chiyoda-ku, Tokyo (JP)

(72) Inventors: Yasuhiro Yoshida, Tokyo (JP); Takuya Yoshida, Tokyo (JP); Tatsuro Yashiki, Tokyo (JP); Kenichiro Nomura, Tokyo (JP); Kazunori Yamanaka, Tokyo (JP); Masaaki Tomizawa, Tokyo (JP); Yuichi Takahashi, Tokyo (JP); Fumiyuki Suzuki, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 275 days.

(21) Appl. No.: 14/079,892

(22) Filed: Nov. 14, 2013

(65) Prior Publication Data

US 2014/0290250 A1 Oct. 2, 2014

(30) Foreign Application Priority Data

Mar. 27, 2013 (JP) ..... 2013-065662

(51) Int. Cl.
*F01K 13/02* (2006.01)
*F01B 31/00* (2006.01)
(Continued)

(52) U.S. Cl.
CPC ..... *F01D 19/02* (2013.01); *F01D 17/02* (2013.01); *F01D 17/08* (2013.01); *F01D 17/085* (2013.01); *F01K 7/165* (2013.01); *F01K 13/02* (2013.01); *F22B 35/00* (2013.01)

(58) Field of Classification Search
CPC ..... F01D 19/02; F01D 17/085; F01D 17/08; F01D 17/02; F22B 35/00; F01K 7/165; F01K 13/02
USPC ..... 60/646, 657, 660, 664
See application file for complete search history.

(56) References Cited

U.S. PATENT DOCUMENTS 4,195,231 A * 3/1980 Reed et al. ..... 290/40 R
4,258,424 A * 3/1981 Giras et al. ..... 700/290
(Continued)

FOREIGN PATENT DOCUMENTS

JP 2002-106305 A 4/2002
JP 2006-257925 A 9/2006
(Continued)

OTHER PUBLICATIONS

European Search Report dated Feb. 20, 2015 (six (6) pages).

*Primary Examiner* — Hoang Nguyen
(74) *Attorney, Agent, or Firm* — Crowell & Moring LLP

(57) ABSTRACT

Disclosed is a steam turbine power plant adapted to start operating very efficiently by highly accurate look-ahead control of a plurality of its startup constraints. The power plant includes a fundamental startup constraint prediction device 32 that calculates from a control input variable of the controller 12, 14 a prediction period about a fundamental startup constraint which is short in response time, a reference control input variables calculating device 33 that calculates such a reference control input variable of the controller 12, 14 as the value predicted and calculated by the fundamental startup constraint prediction device 32 will not exceed a limit value, other startup constraint prediction devices 35*a*, 35*b* each calculating a corresponding prediction period of data about desired one of other startup constraints from the prediction period of reference control input variables data, other control input variable calculating devices 36*a*, 36*b* each calculating corresponding other control input variables of the controller 12, 14 from the value predicted and calculated by the other startup constraint prediction device 35*a*, 35*b*, and a control signal output device 40, 41, 42 or 43 that outputs a command value to the controller 12, 14 in accordance with a value selected from the reference control input variable and the other control input variable.

5 Claims, 6 Drawing Sheets

(51) Int. Cl.

| | |
|---|---|
| ***F01D 19/02*** | (2006.01) |
| ***F01D 17/02*** | (2006.01) |
| ***F01D 17/08*** | (2006.01) |
| ***F01K 7/16*** | (2006.01) |
| ***F22B 35/00*** | (2006.01) |

(56) References Cited

U.S. PATENT DOCUMENTS

| | | | | |
|---|---|---|---|---|
| 4,327,294 | A * | 4/1982 | Smith et al. | 290/40 C |
| 4,888,953 | A | 12/1989 | Fukayama et al. | |
| 5,305,230 | A * | 4/1994 | Matsumoto et al. | 700/287 |
| 7,980,053 | B2 | 7/2011 | Yakushi et al. | |
| 8,240,148 | B2 | 8/2012 | Matsumoto et al. | |
| 2006/0233637 | A1 * | 10/2006 | Yakushi et al. | 415/13 |
| 2009/0288416 | A1 | 11/2009 | Matsumoto et al. | |

FOREIGN PATENT DOCUMENTS

| | | | |
|---|---|---|---|
| JP | 4208397 | B2 | 1/2009 |
| JP | 2009-281248 | A | 12/2009 |
| JP | 4723884 | B2 | 7/2011 |

* cited by examiner

STEAM TURBINE POWER PLANT

BACKGROUND OF THE INVENTION

1. Field of the Invention

The present invention relates to a steam turbine power plant.

2. Description of the Related Art

It is being demanded that a starting time of a steam turbine power-generating plant be further reduced for suppressed instability of the electric power in a grid-connected power system by connecting renewable energy, represented by wind power generation or solar power generation, to the power system. When the steam turbine is started up, however, steam abruptly increases in both temperature and flow rate. A consequential sudden increase in a surface temperature of the turbine rotor relative to an internal temperature thereof augments a radial temperature gradient and thus increases a thermal stress. An excessive thermal stress could shorten a life of the turbine rotor. In addition, if the change in the temperature of the steam is significant, differential thermal expansion due to a difference in heat capacity occurs between the rotor and casing of the turbine. If the differential thermal expansion increases, this could lead to contact between the rotating turbine rotor and the stationary casing, and hence to damage to both thereof. Accordingly, a starting state of the steam turbine needs to be controlled to prevent the thermal stress of the turbine rotor and the differential thermal expansion thereof with respect to that of the casing from exceeding respective maximum permissible levels (refer to Japanese Patent. Nos. 4208397 and 4723884, and JP-2009-281248-A).

SUMMARY OF THE INVENTION

If physical quantities of the steam changes, the rotor, casing, and other sections of the steam turbine suffers changes in a plurality of startup constraints such as a thermal stress and differential thermal expansion. A response time against the changes in the physical quantities of the steam, however, differs according to the kind of startup constraint. For example, the response time against a change in thermal stress, for example, is short by comparison with that of a change in differential thermal expansion. If plant control is based only upon a predicted value of the thermal stress, therefore, this is likely to cause a delay in a change of the differential thermal expansion, thus resulting in the maximum permissible level of the differential thermal expansion being exceeded. Conversely if plant control is based only upon a predicted value of the differential thermal expansion, prediction accuracy decreases since there is a need to predict a value of the future clock time which has advanced by a longer time than current clock time.

The present invention has been made with the above in view, and an object of the invention is to provide a steam turbine power plant adapted to start operating very efficiently by highly accurate look-ahead control of a plurality of its startup constraints.

In order to attain the above object, the present invention includes a heat source equipment that heats a low-temperature flow by applying a heat medium and thus generates a high-temperature flow, a steam generator that generates steam using the high-temperature flow generated by the heat source equipment, a steam turbine driven by the steam generated by the steam generator, an electric generator that converts rotational motive power of the steam turbine into electric power, a controller that controls a plant load, and a steam turbine starting control device that predicts a value of a startup constraint due to a change in physical quantities of the steam in the steam turbine, and controls the controller according to the predicted value, wherein the steam turbine starting control device includes at least one fundamental startup constraint prediction device calculating from a control input variable of the controller a prediction period of fundamental startup constraint data about a fundamental startup constraint which is short in response time with respect to the change in the physical quantities of the steam, at least one reference control input variables calculating device calculating such a reference control input variable of the controller as the value predicted and calculated by the fundamental startup constraint prediction device will not exceed a corresponding limit value, at least one other startup constraint prediction device calculating a corresponding prediction period of data about one of other startup constraints longer than the fundamental startup constraint in response time, from the prediction period of reference control input variables data, at least one other control input variables calculating device calculating such an other control input variable of the controller as the value predicted and calculated by the corresponding other startup constraint prediction device will not exceed a corresponding limit value, and a control signal output device that outputs a command value to the controller according to a value selected from the reference control input variable and the other control input variable.

In accordance with the present invention, a steam turbine power plant starts operating very efficiently by highly accurate look-ahead control of a plurality of its startup constraints.

DESCRIPTION OF PREFERRED EMBODIMENTS

Hereunder, embodiments of the present invention will be described using the accompanying drawings.

First Embodiment

1. Steam Turbine Power Plant

Figure 1:
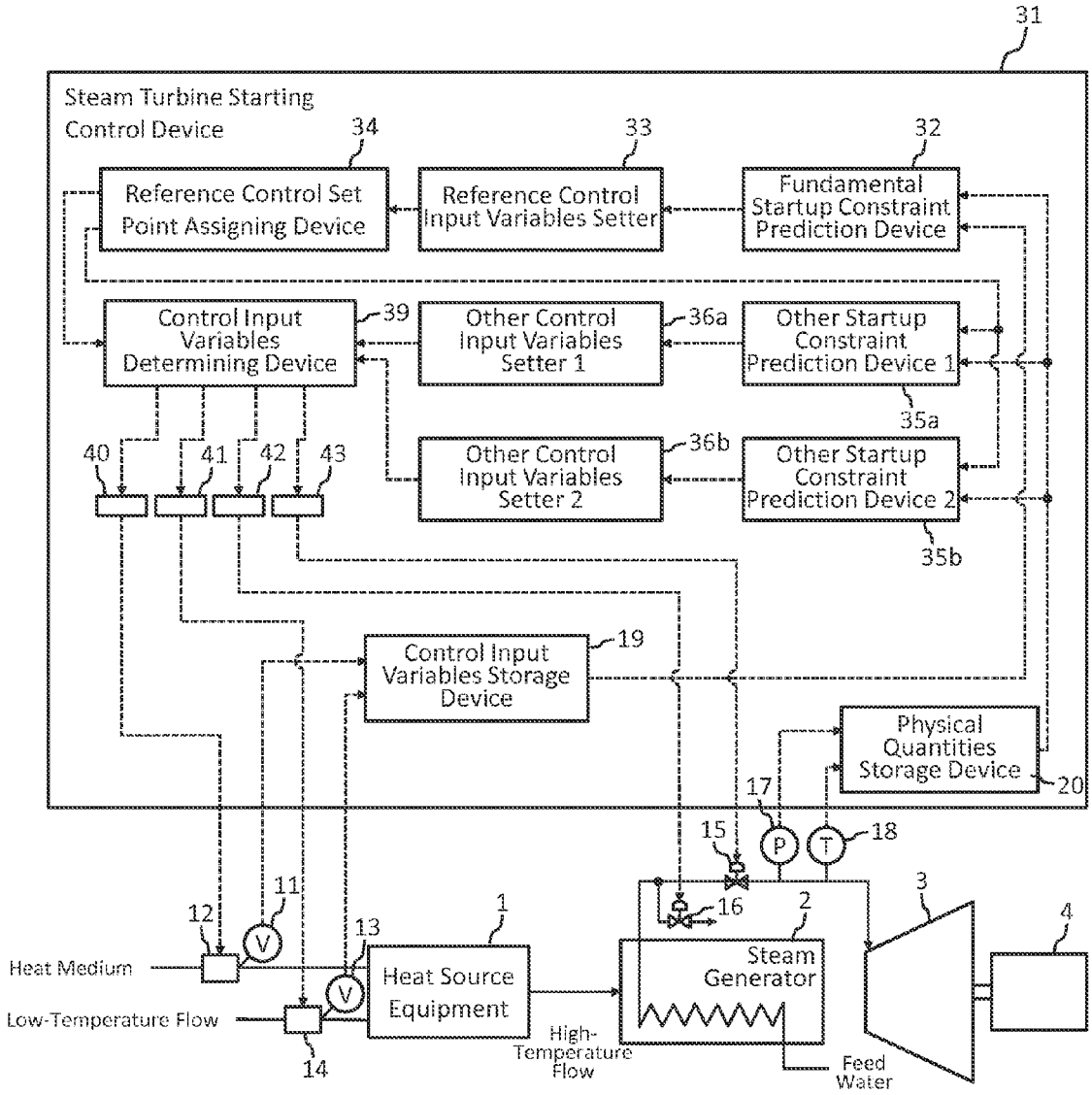
FIG. 1 is a schematic block diagram of a steam turbine power plant according to a first embodiment of the present invention.

FIG. 1 is a schematic block diagram of a steam turbine power plant according to a first embodiment of the present invention.

The steam turbine power plant shown in FIG. 1 includes heat source equipment 1, a steam generator 2, a steam turbine 3, an electric generator 4, a heat medium flow controller 12, a low-temperature flow controller 14, and a steam turbine starting control device 31. An example in which the heat source equipment 1 in the present embodiment is a gas turbine, that is, the steam turbine power plant is of a combined-cycle type, is described below.

The heat source equipment 1 uses the amount of heat possessed by a heat medium (in the present example, a gas fuel, a liquid fuel, a hydrogen-containing fuel, or the like), to heat a low-temperature flow (in the example, a flow of air burned with the fuel) and supply this heated flow as a high-temperature flow (in the example, a combustion gas that has been used to drive the gas turbine) to the steam generator 2. The steam generator 2 (in the present example, a waste heat recovery boiler) heats feed water by heat exchange with the heat held by the high-temperature flow which has been generated by the heat source equipment 1, and thereby generates steam. The steam thus generated by the steam generator 2 is next used to drive the steam turbine 3. The electric generator 4 is coaxially coupled to the steam turbine 3, and the generator 4 converts rotational driving force of the steam turbine 3 into electric power. The electric power that the generator 4 has generated is output to, for example, an electric power system (not shown).

The heat medium flow controller 12 (in the present example, a fuel control valve) is provided on a heat medium supply route leading to the heat source equipment 1, and the heat medium flow controller 12 controls a flow rate of the heat medium supplied to the heat source equipment 1. The low-temperature flow controller 14 (in the present example, IGV) is provided on a low-temperature flow supply route leading to the heat source equipment 1, and the low-temperature flow controller 14 controls a flow rate of the low-temperature flow supplied to the heat source equipment 1. The controllers 12 and 14 each function as a controller to control a load upon the steam turbine power plant. The controllers 12, 14 are each fitted with a control input variables measuring instrument. 11 or 13, by which is measured a control input variable (in the present example, a valve opening angle) of the controller 12, 14. The control input variable of the controller 12, 14 that the control input variables measuring instrument 11, 13 has measured is input to the steam turbine starting control device 31.

In addition, a main steam flow control valve 15 that controls a flow rate of the steam supplied to the steam turbine 3 is provided on a main steam line connecting the steam generator 2 and the steam turbine 3. A bypass system that vents to an external system a part of the steam which has been generated by the steam generator 2 branches off from the main steam line. A position at which the bypass system branches off from the main steam line is between the steam generator 2 and the main steam flow control valve 15. The bypass system is provided with a bypass valve 16 to control a flow rate of the steam in the bypass system. Furthermore, a pressure gauge 17 and a temperature gauge 18 are provided at positions closer to a side downstream of the steam turbine 3 than to the branching position of the bypass system on the main steam line. The pressure gauge 17 and the temperature gauge 18 measure a pressure and temperature, respectively, of a main steam flow streaming through she main steam line, and output corresponding signals to the steam turbine starting control device 31. The main steam flow control valve 15 and the bypass valve 16 also have a controller function to control the load of the steam turbine power plant.

2. Steam Turbine Starting Control Device

The steam turbine starting control device 31 predicts startup constraints due to changes in physical quantities of the steam in the steam turbine 3, and controls the controllers 12, 14 on the basis of the predicted startup constraint values. The steam turbine starting control device 31 includes the following elements: a control input variables storage device 19, a physical quantities storage device 20, a fundamental startup constraint prediction device 32, a reference control input variables setter 33, a reference control input variables assigning device 34, other startup constraint prediction devices 35*a* and 35*b*, other control input variables setters 36*a* and 36*b*, a control input variables determining device 39, and control signal output devices 40 to 43. These elements are described in order below.

(1) Control Input Variables Storage Device

The control input variables storage device 19 receives information on the control input variable of the controller 12, 14 that the control input variables measuring instrument 11, 13 has measured, and stores the information along with clock time information into a data storage location on a time-series basis.

(2) Physical Quantities Storage Device

Inc physical quantities storage device 20 receives information on the pressure and temperature of the main steam flow that the pressure gauge 17 and the temperature gauge 18 have measured, and stores the information along with clock time information into the data storage location on a time-series basis.

(3) Fundamental Startup Constraint Prediction Device

The fundamental startup constraint prediction device 32 receives measured-value information on the control input variable of the flow controller 12, 14, read out from the control input variables storage device 19 during startup of the steam turbine power plant. The prediction device 32 also receives measured-value information on the pressure and temperature of the main steam flow, read out from the physical quantities storage device 20 during the startup of the steam turbine power plant. Next, the fundamental startup constraint prediction device 32 predicts, from the control input variable of the controller 12, 14, future values of the startup constraints estimated to be imposed upon the steam turbine 3 after an elapse of a preset time period from the current time of day, and outputs the predicted values to the reference control input variables setter 33 (in the present example, a gas turbine controller). In addition, the fundamental startup constraint prediction device 32 calculates current startup constraints based on the measured pressure and temperature values of the main steam flow, and outputs results of the calculation to the reference control input variables setter 33 similarly to the above.

The preset time period mentioned above refers to the longest prediction period (described later herein) or a period that has been set to be longer than the prediction period. The startup constraints refer to those changes in physical quantities due to abrupt increases in steam temperature, steam pressure, or the like, that will appear when the steam turbine 3 is started. The physical quantities here are a magnitude of a thermal stress applied to a rotor of the steam turbine 3, that of axial differential thermal expansion in the turbine rotor and a casing accommodating the turbine rotor, and other variables developing during the startup of the turbine. Hereinafter, when the wording "thermal stress" is used, this simply means the thermal stress upon the turbine rotor, and when the wording "differential thermal expansion" is used, this simply means the axial differential thermal expansion of the turbine rotor and the casing. In addition, the prediction period is a time that includes a response time from a start of controlling the controller 12, 14, the main steam flow control valve 15, and the bypass valve 16, and imparting a change to steam conditions of the main steam flow, until the steam turbine 3 has suffered a change in startup constraint. That is to say, the prediction period is either equal to the response time or a time that has been set to be longer than the response time. The prediction period differs according to the kind of startup constraint. For example, a time required for a thermal stress to start changing for a reason such as a delay in heat transfer is shorter than a time required for differential thermal expansion to start developing for a reason such as the delay in heat transfer.

The fundamental startup constraint prediction device 32 predicts, of all the startup constraints that the steam turbine starting control device 31 is to predict, only the startup constraint that is shortest in response time. Hereinafter, the startup constraint that the fundamental startup constraint prediction device 32 calculates by prediction is referred to as the "fundamental startup constraint", and in the present embodiment, an example of taking a thermal stress as the fundamental startup constraint is shown and described below. In addition, the prediction period that has been set for predicting the fundamental startup constraint is hereinafter termed the "reference prediction period.", and of all the startup constraints that the steam turbine starting control device. 31 is to predict, the fundamental startup constraint is shortest in response time, so the reference prediction period is the shortest of all startup constraint prediction periods.

Sequences A1 to A4 that relate to the calculation of a thermal stress by the fundamental startup constraint prediction device 32 are set forth below.

Sequence A1

The control input variable of the controller 12, 14 corresponds to rates at which the heat medium and the low-temperature flow are supplied to the heat source equipment 1, and is therefore closely related to a thermal load state of the heat source equipment 1. Accordingly, first a process in which heat and matter propagate from the heat source equipment 1 through the steam generator 2 to the steam turbine 3 is calculated from the control input variable of the controller 12, 14 that the control input variables measuring instrument 11, 13 has measured. Next, a flow rate, pressure, temperature, and other plant physical quantities of the steam that are estimated to be reached at an entrance of the steam turbine 3 after the preset time period has elapsed are further calculated from a result of that calculation. Predictive computation of the plant physical quantities estimated to be reached after the elapse of the preset time period, can be conveniently conducted from the values measured by the control input variables measuring instruments 11, 13 by assuming one specific pattern of changes in physical quantities that is based on an assumption that current change rates of the heat medium flow rate and the low-temperature flow rate (i.e., change rates of the control input variables of the controller 12, 14, the main steam control valve 15, and the bypass valve 16) remain invariant from the current time to the preset time period.

At this time, prediction accuracy further improves if the plan physical quantities that have been predicted from the values measured by the control input variables measuring instruments 11, 13 are corrected using the values measured by the pressure gauge 17 and the temperature gauge 18. For example, as plant operation advances, a certain correlation is likely to occur between the predicted values and measured values of the steam pressure and the steam temperature. This may occur in a form that the predicted value is calculated as a certain level higher or lower than the measured value. Such a correlation is stored as a relational expression or a table in a data storage region of the fundamental startup constraint prediction device 32, and in accordance with the correlation, the values that have been calculated in the above sequence by prediction are corrected on the basis of the values measured by the pressure gauge 17 and the temperature gauge 18.

Sequence A2

Next on the basis of the calculation results in sequence A1, pressures, temperatures, heat transfer coefficient, and other variables at various stages of the steam turbine 3 are calculated allowing for a pressure drop at a first stage of the steam turbine 3.

Sequence A3

Heat transfer of the steam to the turbine rotor is calculated from the calculation results in sequence A2, and after that, a temperature distribution in a radial direction of the turbine rotor is calculated from a result of that calculation.

Sequence A4

Finally, the thermal stress estimated to occur after the elapse of the preset time period, is calculated from the calculation result in sequence A3, pursuant to the rules of mechanics of materials that use a coefficient of linear expansion, Young's modulus, Poisson ratio, and/or the like.

The fundamental startup constraint prediction device 32 calculates the fundamental startup constraint at a predetermined sampling period in the above sequences and sequentially outputs calculation results to the reference control input variables setter (4) Reference Control Input Variables Setter The reference control input, variables setter 33 stores into a data storage location the predicted values and current values of the fundamental startup constraint that are sequentially input from the fundamental startup constraint prediction device 32. Next using the reference prediction period of time-series data that has been input from the fundamental startup constraint prediction device. 32, the reference control input, variables setter 33 calculates a reference control input variable of the controller 12, 14 that does not cause the fundamental startup constraint to exceed its limit value (set point) during the startup process for the steam turbine power plant. For example, the reference control input variable is calculated as a value that reduces a difference between the limit value and the predicted value (e.g., peak value of the reference prediction period of time-series data) that was calculated in regard to the fundamental startup constraint. Those reference control input variables of the main steam control valve 15 and bypass valve 16 that bring the current value of the fundamental startup constraint close to the limit value are calculated along with the above difference. The reference control input variables that have hereby been calculated are output to the reference control input variables assigning device 34. The reference control input variables setter 33 sequentially calculates each reference control input variable in time-shifted form (i.e., in different timing) at the sampling period, of the fundamental startup constraint, and sequentially outputs calculation results to the reference control, input variables assigning device 34.

(5) Reference Control Input Variables Assigning Device

The reference control input variables assigning device 34 stores the sequentially received reference control input variables and then after the longest prediction period of reference control input variables data has been stored, outputs the time-series data corresponding to the reference control input variables, to the startup constraint prediction devices 35*a*, 35*b* in parallel. The longest prediction period here means the prediction period that was set for the startup constraint whose response time is the longest of all that of the startup constraints which the steam turbine starting control device 31 predicts. Although the control input variable of the controller 12, 14, measured by the control input variables measuring instrument 11, 13, is input to the fundamental startup constraint prediction device 32, the control input variable is not input to the startup constraint prediction devices 35*a*, 35*b*.

Instead, the reference control input variable of the controller 12, 14, measured by the reference control input variables setter 33, is input to the startup constraint prediction devices 35*a*, 35*b*.

(6) Other Startup Constraint Prediction Devices 25*a*, 35*b*

The other startup constraint prediction devices 35*a*, 35*b* each calculate the corresponding prediction period of data only about desired one of all startup constraints to be predicted, except for the fundamental startup constraint. Naturally, the startup constraint that the startup constraint prediction device 35*a* calculates by prediction is long in response time, compared with a reference startup constraint, and the corresponding prediction period is also long relative to the reference prediction period. In addition, the startup constraint that the startup constraint prediction device 35*b* calculates by prediction is long in response time, compared with the startup constraint that the startup constraint prediction device 35*a* calculates by prediction, and the corresponding prediction period also is correspondingly long. In a case that the steam turbine starting control device 31 calculates two kinds of startup constraints by prediction, therefore, the prediction period used by the startup constraint prediction device 35*a* becomes the longest prediction period. The relative length of response time between the startup constraints that the startup constraint prediction devices 35*a*, 35*b* predict, however, has no technical meaning and whichever of the two startup constraints can be longer or shorter in response time.

Using the assigned longest prediction period of reference control input variables time-series data (if the prediction period is shorter than the longest one, then the first prediction period of time-series data in the longest prediction period), the startup constraint prediction devices 35*a*, 35*b* each calculate the corresponding prediction period of time-series data about the startup constraints to be predicted, and output calculation results to the control input variables setters 36*a* and 36*b*, respectively. A method of calculating these values by prediction is substantially the same as that of the predictive calculation of the fundamental startup constraint, except that the control input variable to become a basis is a calculated value, not a measured value. A known method of calculation may be applied to each startup constraint. In addition, as is the case with the predicted value of the fundamental startup constraint, the startup constraint prediction device 35*a*, 35*h* may use the data measurements by the pressure gauge 17 and the temperature gauge 18 to correct the predicted value. Furthermore, the startup constraint prediction device 35*a* or 35*b* uses the measured pressure and temperature values of the main steam flow to calculate current values of the startup constraints, and then outputs calculation results to the control input variables setter 36*a* or 36*b*, respectively, in a manner similar to the above.

For example, when predictive calculation of differential thermal expansion is conducted with the startup constraint prediction device 35*a*, calculation sequences shown as B1 so B5 below can be applied.

Sequence B1

The flow rate, pressure, temperature, and other factors of the steam that are estimated to be reached at the entrance of the steam turbine 3 after the preset time period has elapsed are calculated in substantially the same manner as that of thermal stress calculation.

Sequence B2

On the basis of calculation results obtained in sequence B1, the pressures, temperatures, heat-transfer coefficients, and other factors of various sections of the turbine rotor and casino are calculated allowing for pressure drops at the various sections of the turbine rotor and casing.

Sequence B3

Temperatures of various sections of the turbine rotor and casino as cut in an axial direction of the turbine are calculated by heat-transfer calculation based on results of the calculation in sequence B2.

Sequence B4

The amounts of axial thermal change (expansion) of the turbine rotor and casing are calculated from results of the calculation in sequence B3.

Sequence B5

On the basis of calculation results obtained in sequence B4, differential thermal expansion of the turbine rotor and casing after the elapse of the preset time period is calculated in accordance with, for example, the rules of mechanics of materials that uses a coefficient of linear expansion.

(7) Other Control Input Variables Setters

The other control input variables setters 36*a*, 36*b* each calculate and set, from the prediction period of data that has been input from the startup constraint prediction device 35*a*, 35*b*, such control input, variable of the controller 12, 14 that brings the predicted value of the startup constraint close to a threshold value. Such control input variables of the main steam flow control valve 15 and bypass valve 16 that bring current values to the respective limit values are also calculated. This calculation uses substantially the same method as for the reference control input variable.

(8) Control Input Variables Determining Device

The control input variables determining device 39 selects, from the control input variables set by the control input variables setters 33, 36*a*, 36*h*, settings that satisfy the conditions under which none of the startup constraints oversteps respective threshold values, and determines the selected settings as the control input variables to be output. In this case, desired control input variables are selected on a smaller-value selection basis, for example. In addition, while FIG. 1 shows an example of a configuration in which the reference control input variable is input as a candidate to the control input variables determining device 39 via the reference control input variables assigning device 31, since the control input variables calculated by the control input variables setters 36*a*, 36*b* are based on the reference control input variable, the conditions under which the fundamental startup constraint does not overstep the threshold value are satisfied by necessity. The reference input variable may therefore be excluded from candidates that are input to the control input variables determining device 39.

(9) Control Signal Output Devices

The control signal output devices 40-43 each output a command value to the controller 12, 14, the main steam flow control valve 15, and the bypass valve 16, in accordance with the values that have been selected from the reference control input variable and the other control input variables. Of the control input variables that have been selected by the control input variables determining device 39, the control input variable addressed to the heat medium flow controller 12 is output to the control signal output device 40. Similarly, the control input variable addressed to the low-temperature flow controller 14 is output to the control signal output device 41, the control input variable addressed to the main steam flow control valve 15 is output to the control signal output device 43, and the control input variable addressed to the bypass valve 16 is output to the control signal output device 42.

The control signal output device 40 calculates the command value addressed to the heat medium flow controller 12, from the received control input variable and outputs the calculated command value to the heat medium flow controller 12. The command value to the heat medium flow controller 12 is determined by numerically represented device characteristics. For example, in the present embodiment, the command value is calculated from a fuel flow rate that satisfies the gas turbine load command (MWD). As a result, the heat medium controller 12 executes PID control so that the control input variable measured by the control input variables measuring instrument 11 will be controlled to approach a target value (set point) of the control input variable.

The control signal output device 41 calculates the command value addressed to the low-temperature flow controller 14, from the received control input variable and outputs the calculated command value to the low-temperature flow controller 14. The command value to the low-temperature flow controller 14 is also determined by the numerically represented device characteristics. For example, in the present embodiment, the command value is calculated from an air flow rate that satisfies a gas turbine speed command. As a result, the low-temperature flow controller 14 executes PID control so that the control input variable measured by the control input variables measuring instrument 13 will be controlled to approach a target value (set point) of the control input variable.

Similarly to the above, the control signal output devices 42, 43 each calculate the command value addressed to the bypass valve 16 or the main steam flow control valve 15, respectively, from the received control input variable and outputs the calculated command value to the valve 16, 15. As a result, the bypass valve 16 and the main steam flow control valve 15 execute PID control so that a control input variable measured by a corresponding control input variables measuring instrument (not shown) will be controlled to approach a target value (set point) of the control input variable.

3. Starting Control Sequence

Figure 2:
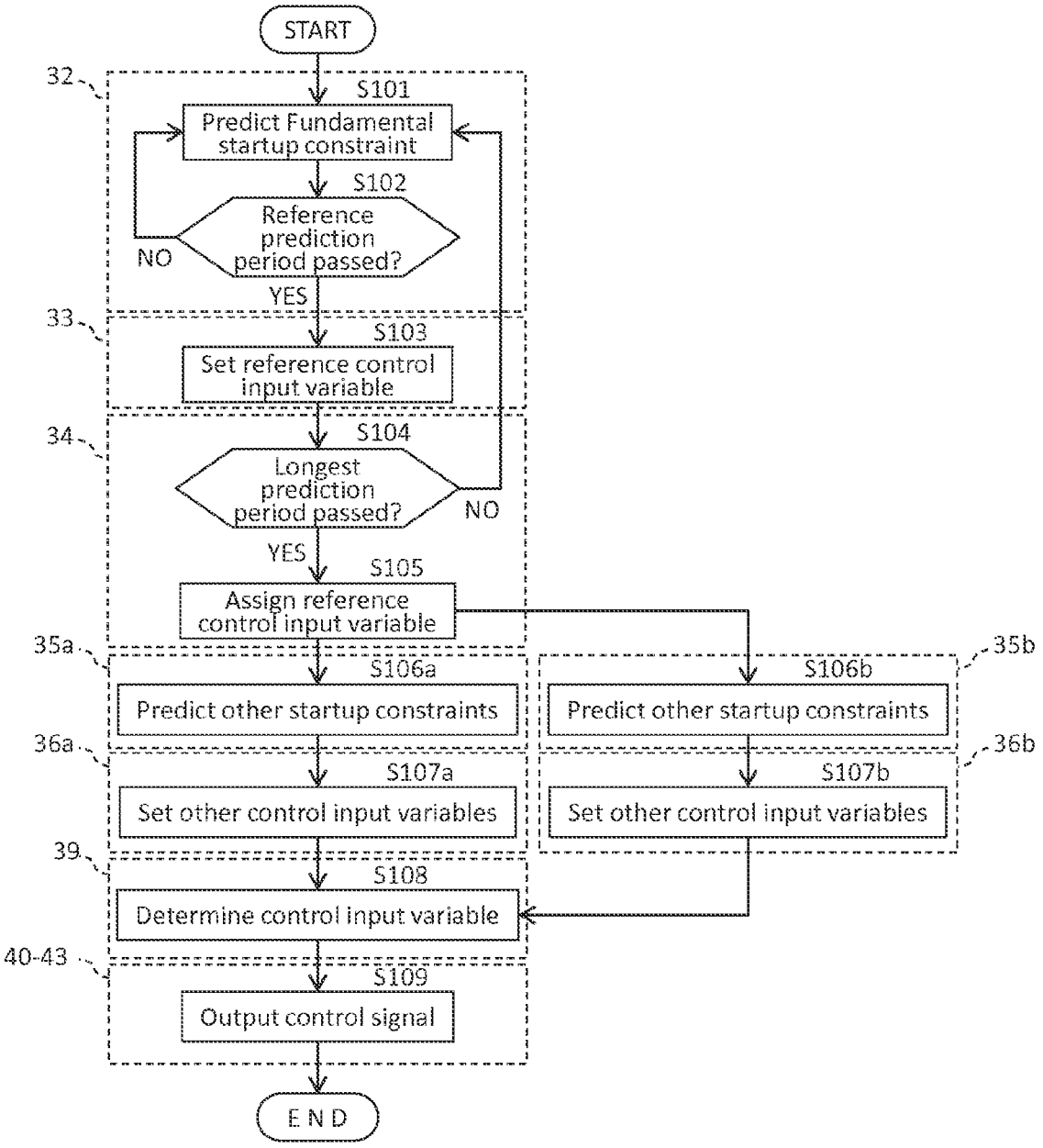
FIG. 2 is a flowchart that represents a starting control sequence relating to the steam turbine power plant according to the first embodiment of the present invention.
Figure 3:
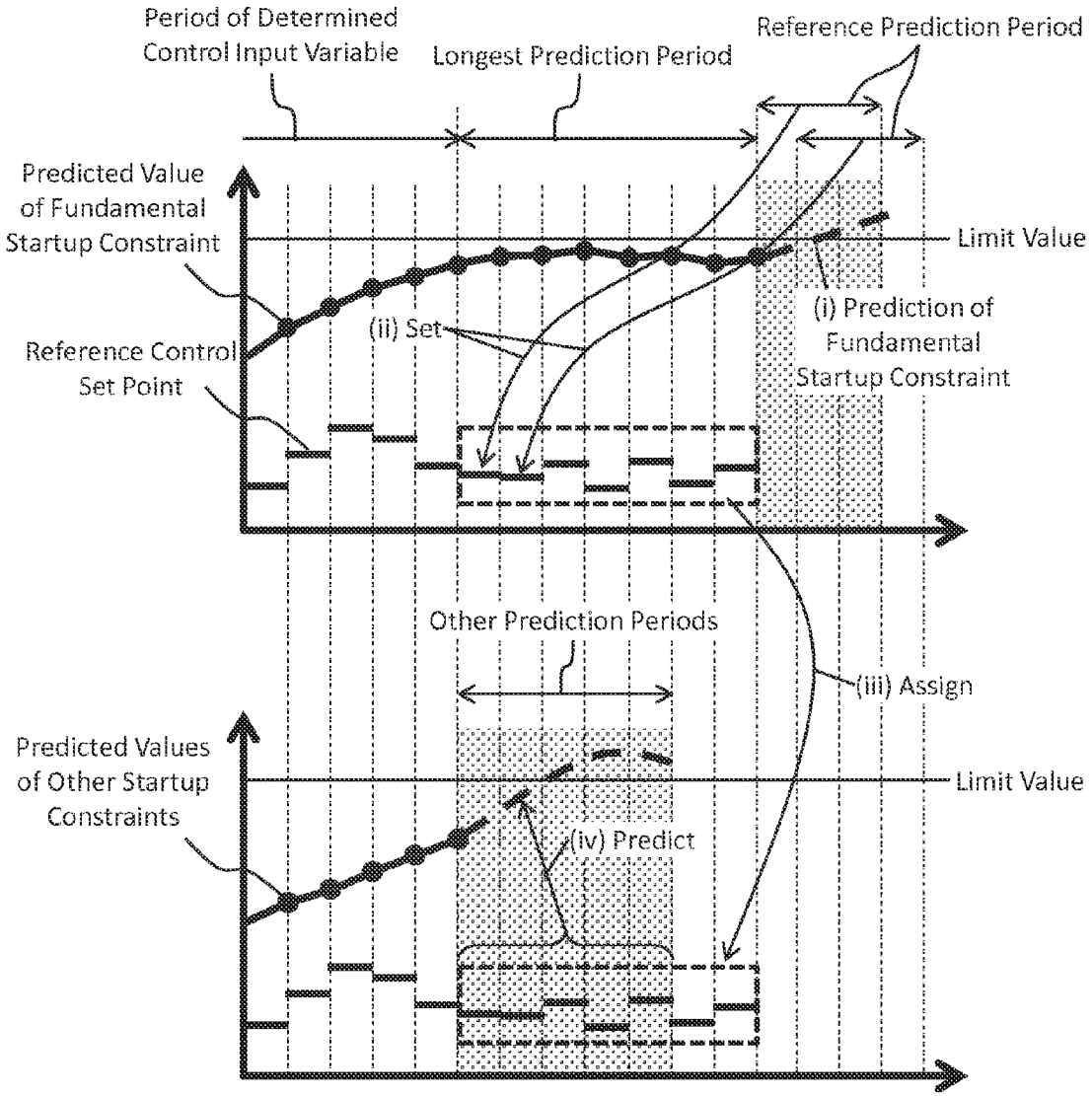
FIG. 3 is a supplemental explanatory diagram of the starting control sequence relating to the steam turbine power plant.

FIG. 2 is a flowchart representing a starting control sequence that the steam turbine starting control device 31 executes for the steam turbine 3, and FIG. 3 is a supplemental explanatory diagram of the starting control sequence.

Steps S101 and S102

As shown in FIG. 2, steps S101 and S102 constitute a startup constraints prediction data-sampling sequence that the fundamental startup constraint prediction device 32 executes (see section (i) of FIG. 3). That is to say, when the steam turbine starting control device 31 starts the steam turbine 3, the control device 31 first starts the data-sampling sequence and activates the fundamental startup constraint prediction device 32 to calculate the physical quantities that the plant is estimated to have after the elapse of the preset time period, and then conduct predictive calculation of startup constraints from the calculated plant physical quantities (step S101). The current value of the fundamental startup constraint is also calculated from the measured pressure and temperature values of the main steam flow. The plan physical quantities calculation sequence and the startup constraints calculation sequence are as described above. In addition, since the present embodiment assumes one specific pattern of change that as described above, the control input variable of the controller 12, 14 changes linearly at a current rate of change to ensure a lighter processing load, the startup constraints are calculated assuming such linear changes in fundamental startup constraint (in the present example, thermal stress). After the calculation of the startup constraints, the prediction device 32 determines whether the reference prediction period has passed from the start of processing (step S102), and next until the reference prediction period has passed, repeats steps S101, S102 to execute sampling of the predicted values and current values of the startup constraints at fixed cycles (processing cycles of steps S101, S102).

Step S103

Step S103 constitutes a sequence executed by the reference control input variables setter 33, and this sequence is used to calculate and set the reference control input variable from the fundamental startup constraint (see section (ii) of FIG. 3). To be more specific, after the reference prediction period of predicted fundamental startup constraint data has been sampled, the control input variable of the controller 12, 14 that brings the reference prediction period of predicted fundamental startup constraint, data (e.g., the peak value of the corresponding time-series data) close to the limit value is calculated and set. The control input variables calculated for the main steam flow control valve 15 and the bypass valve 16 will be set to bring the current value of the fundamental startup constraint close to the corresponding limit value.

Steps S104 and S105

Steps S104 and S105 constitute a sequence executed by the reference control input variables assigning device 34, and this sequence is used to continuously sample the longest prediction period of predicted reference control input variables data and assign this data as a basis for the predictive calculation of other startup constraints (see section (iii) of FIG. 3). To be more specific, the reference control input variables assigning device 34 executes step S104 to determine whether the longest prediction period has passed from the start of processing, and sample the predicted values of the longest prediction period of predicted reference control input variables data. The reference control input variables thus received are added to those which have already been received, and thus the time-series data corresponding to the longest prediction period of predicted reference control input variables data is output to the startup constraint prediction devices 35*a*, 35*b* as a basis for the predictive calculation of the startup constraints (step S105).

Steps S106*a* and S106*b*

Steps S106*a* and S106*b* constitute a sequence executed by the startup constraint prediction devices 35*a*, 35*b*, and this sequence is used to predict and calculate the relevant startup constraint based on the reference control input variables. For example, since the prediction period is shorter than the longest prediction period, the startup constraint prediction device 35*a* calculates, from the first relevant prediction period of data in the time-series data of reference control input variables data that has been input, the time-series data corresponding to the longest prediction period of predicted reference control input variables data (see section (iv) of FIG. 3). Since the physical quantities change prediction time is equal to the longest prediction period, the startup constraint prediction device 35*b* calculates the longest prediction period of predicted startup constraint time-series data from all periods of reference control input variables data that has been input. A method of calculating the startup constraints by prediction is as described above. Current values of the pressure and temperature of the main steam flow are also calculated from the respective measured values.

Steps S107*a* and S107*b*

Steps S107*a* and S107*b* constitute a sequence executed by the control input variables setters 36*a*, 36*b*, and this sequence is used to calculate and set, from the time-series data of the predicted values of the corresponding startup constraints, the control input variable of the controller 12, 14 that brings the predicted value of each startup constraint close to the limit value. The control input variables of the main steam flow control valve 15 and the bypass valve 16 are calculated and set in substantially the same manner as above. The calculation sequence relating to these control input variables is equal to that of the reference control input variable.

Step S108

Step S108 constitutes a sequence executed by the control input variables determining device 39, and this sequence is used to select a control input variable that satisfies the limits of the startup constraints, and then to output the selected variable to one of the control signal output devices 40 to 43. Details of the sequence are as described above. For example, a final control input variable is determined on a smaller-value selection basis from both control input variables that the control input variables setters 36*a*, 36*b* have calculated. In the sequence that FIG. 2 shows, the reference control input variable is not included in candidates. Since the control input variables calculated by the control input variables setters 36*a*, 36*b* are based on the reference control input variable, 'either-or' selection provides substantially the same advantageous effects as in the case that the fundamental startup constraint is included in the candidates.

Step S109

Step S109 constitutes a sequence executed by the control signal output devices 40-43, and this sequence is used to output the command values to the controllers 12, 14, the main steam flow control valve 15, and the bypass valve 16, in accordance with the control input variables that have been input. Details of the sequence are as described above. The output of the command values to these elements allows look-ahead control, of the temperature and pressure of the main steam flow streaming into the steam turbine 3, and thus allows various startup constraints to be prevented from reaching the respective limit values after that.

A plurality of programs to execute here the sequence shown in FIG. 2 are active at the determining period of the control input variables with time differences. Accordingly the command values are newly imparted to the controllers 12, 14, the main steam flow control valve 15, and the bypass valve 16, at the determining cycle of the control input variables by the programs active with the time differences. Thus the command values based on the predicted startup constraints data corresponding to the prediction period longer than a response time of the startup constraints are imparted to the controllers 12, 14, the main steam flow control valve 15, and the bypass valve 16, at a determining cycle shorter than the prediction period.

Look-ahead control of the physical quantities of the steam generated by the steam generator 2 will be conducted by repeated execution of the above sequence.

In the present embodiment, the heat medium flow rate command value and the main steam flow rate command value have been described as the plant physical quantities determined by the control input variables setters, but one of the two command values may instead be determined.

4. Effects

The present embodiment yields the following advantageous effects.

(1) Rapid Start of the Steam Turbine

In accordance with the present embodiment, the amount and temperature of steam generated by the steam generator 2 can be controlled by controlling at least one of the flow rates of the heat medium and low-temperature flow supplied to the heat source equipment 1, an element provided at a front stage of the steam generator 2. For example, the steam temperature can be mainly controlled by operating the heat source flow controller 12 and controlling the flow rate of the heat medium. This is because the steam temperature changes with a temperature of a high-temperature flow supplied to the steam generator 2. Additionally, the flow rate of the steam can be mainly controlled by operating the low-temperature flow controller 14 and controlling the flow rate of the low-temperature flow. This is because controlling the flow rate of the low-temperature flow controls that of the high-temperature flow, hence changing the amount of steam generated in the steam generator 2.

In this way, the flow rate and temperature of the steam that are the physical quantities closely associated with the startup constraints such as a thermal stress and differential thermal expansion can both be regulated. This in turn enables she steam flow and she steam temperature to be controlled flexibly according to a particular state of the steam turbine 3, and thus allows the steam turbine 3 to be started rapidly in an appropriate way.

In addition, the amount of steam generated can itself be increased, so the amount of steam generated can itself be increased and reduced more significantly than in a case that the flow rate of the main steam flow is controlled only via the main steam flow control valve 15, and this a wider steam conditions control allowance can be obtained. This can be another factor contributing to a rapid start.

(2) Suppressed Energy Loss

In the present embodiment, since the amount of steam generated in the steam generator 2 can itself be increased, the steam temperature and the amount of steam generated can be controlled flexibly according to operating conditions. Unless otherwise necessary, this makes it unnecessary to discharge existing excess steam to an external system via the bypass valve 16 and enables energy loss to be correspondingly suppressed.

(3) Improved Accuracy of Look-Ahead Control

Depending upon the response time, an appropriate prediction period is set for each of a plurality of startup constraints, and control input variables are determined from the startup constraints corresponding to the prediction periods. Control input variables can be determined in anticipation of subsequent changes in startup constraint, so this determination improves look-ahead, control accuracy of the plurality of startup constraints that become bottlenecks in the startup of the steam turbine, including the startup constraints that are long in response time. In particular, if the fundamental startup constraint that is the shortest of a plurality of startup constraints in response time is calculated by prediction and the startup constraints chat are long in response time are calculated, by prediction from the reference control input variable from which relatively high calculation accuracy is anticipated, then the startup constraints that are long in response time can also be calculated with high accuracy by prediction.

(4) Using 7 the controllers 12, 14 to coordinate the control of the heat source equipment 1 and that of the main steam flow control valve 15 further improves follow-up characteristics of the startup constraints with respect to the respective control set points. For example, the startup constraints can be controlled to satisfy their limit values in the above control modes, by merely controlling the heat source equipment 1 with the controllers 12, 14 only. In case of disturbance due to operating conditions of the plant or a state of a device, however, the startup constraints are likely to decrease in control accuracy. In the present embodiment, on the other hand, whereas the control input variables determined for the controllers 12, 14 are such values as will cause the predicted values of the startup constraints to approach the limit values, the control input variable determined for the main steam flow control valve. 15 is such a value as will cause the calculated value of the current startup constraint to approach the limit value. The fact that the control of the main steam flow control valve 15, based upon she current value, is thus added to she look-ahead control of the heat source equipment. 1, based upon the predicted values, improves the follow-up characteristics of the startup constraints with respect to the respective control set points.

Second Embodiment

Figure 4:
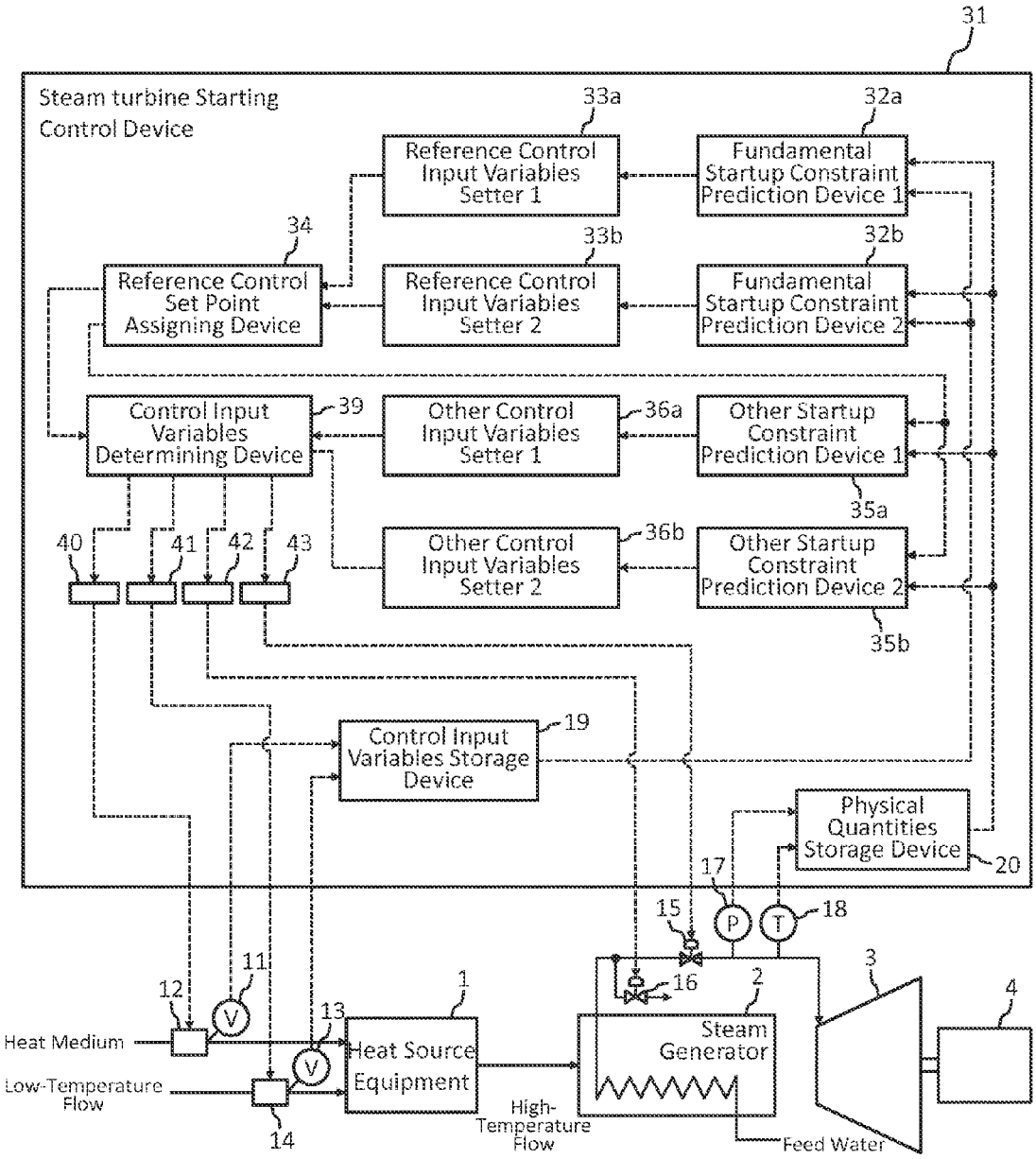
FIG. 4 is a schematic block diagram of a steam turbine power plant according to a second embodiment of the present invention.

FIG. 4 is a schematic block diagram of a steam turbine power plant according to a second embodiment of the present invention. In the figure, substantially the same elements as in the first embodiment are each assigned the same reference number as on the shown drawings, and description of these elements is omitted herein.

As shown in FIG. 4, the present embodiment differs from the first embodiment in that the former selects a plurality of kinds of fundamental startup constraints and in that the former includes one set of fundamental startup constraint prediction devices and reference control input variables calculating devices for each of the plurality of kinds of fundamental startup constraints. More specifically, the steam turbine starting control device. 31 in the present embodiment is equipped with fundamental startup constraint prediction devices 32*a*, 32*b* and reference control input, variables calculating devices 33*a*, 33*b*. The fundamental startup constraint prediction devices 32*a*, 32*b* each calculate the intended startup constraints by prediction from the control input variables of the controllers 12, 14, and the reference control input variables calculating devices 33*a*, 33*b* each calculate the reference control input variables of the controllers 12, 14 from the predicted values that have been calculated by the fundamental startup constraint prediction devices 32*a*, 32*b*. In addition, the reference control input variables of the main steam flow control valve 15 and the bypass valve 16 are calculated from current values of the intended startup constraints. Methods of calculating these values are substantially the same as the method of calculating the reference control input variable in the first embodiment.

In the present embodiment, the plurality of reference control input variables relating to the different kinds of fundamental startup constraints calculated by the reference control input variables calculating devices 33*a*, 33*b* are input to the reference control input variables assigning device 34 and then one of the reference control input variables is selected. This selection is conducted on a smaller-value selection basis, for example. The longest prediction period of time-series data corresponding to the selected control input variable is output to the startup constraint prediction devices 35*a*, 35*b*.

Inc present embodiment is substantially the same as the first embodiment in that the startup constraints predicted by the fundamental startup constraint prediction devices 32*a*, 32*b* are shorter in response time than those predicted by the startup constraint, prediction devices 35*a*, 35*b*. In other words, the startup constraint that is the longest in response time of all the startup constraints predicted by the fundamental startup constraint prediction devices 32*a*, 32*b* is shorter in response time than the startup constraint that is the shortest in response time of all the startup constraints predicted by the startup constraint, prediction devices 35*a*, 35*b*.

Other configurational factors are substantially the same as in the first embodiment.

Figure 5:
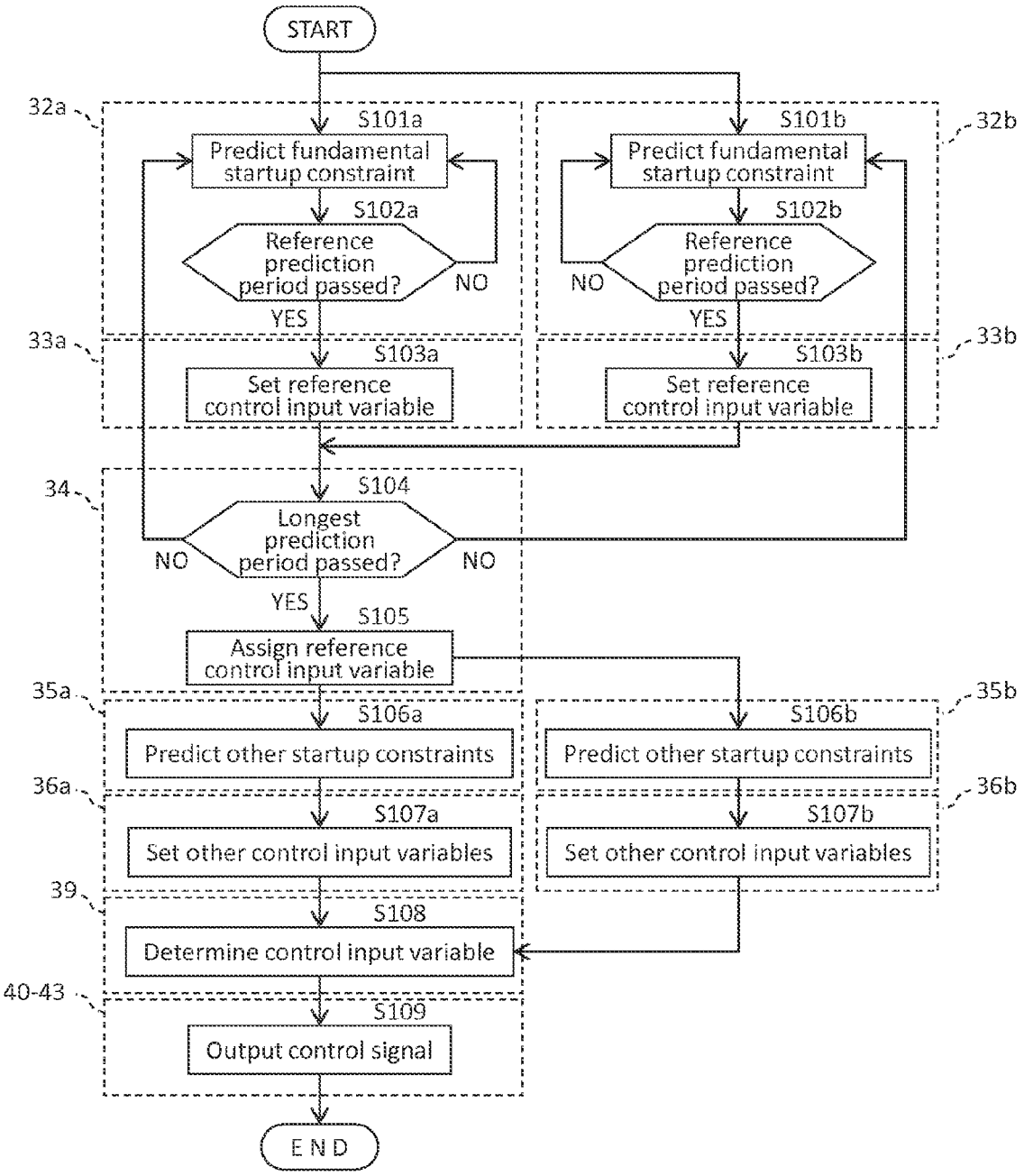
FIG. 5 is a flowchart that represents a starting control sequence relating to the steam turbine power plant according to the second embodiment of the present invention.

FIG. 5 is a flowchart that represents a starting control sequence executed for the steam turbine power plant by the steam turbine starting control device 31 according to the present embodiment.

As shown in FIG. 5, after a start of processing in the present embodiment, predictive calculation of a prediction period of data corresponding to a plurality of startup constraints (steps S101*a*, S101*b*, S102*a*, S102*b*), and setting of the reference control input variables of the controllers 12, 14 (steps S103*a*, S103*b*) are executed in parallel by the fundamental startup constraint prediction devices 32*a*, 32*b* and the reference control input variables calculating devices 33*a*, 33*b*. A sequence that steps S101*a*-S103*a* constitute, and a sequence that steps S101*b*-S103*b* constitute are substantially the same sequences as those of steps S101-S103 (see FIG. 2) in the first embodiment. Next after the longest prediction period of data including the reference control input variables of the main steam flow control valve 15 and the bypass valve 16 has been sampled (step S104), either of the reference control input variables is selected by the reference control input variables assigning device 34 and output to the startup constraint prediction device 35*a*, 35*b* (step S105). Subsequent steps S106 to 3109 are substantially she same as in the first embodiment (see FIG. 2).

In this way, one appropriate reference control input variable is selected from one group of startup constraints that has been calculated as reference control input variables and that is shortest in response time (i.e., shorter than other startup constraints). This selection improves adequacy of the control input variable, thus improving startup constraint, control accuracy by predicting other startup constraints based upon the control input variable.

Third Embodiment

Figure 6:
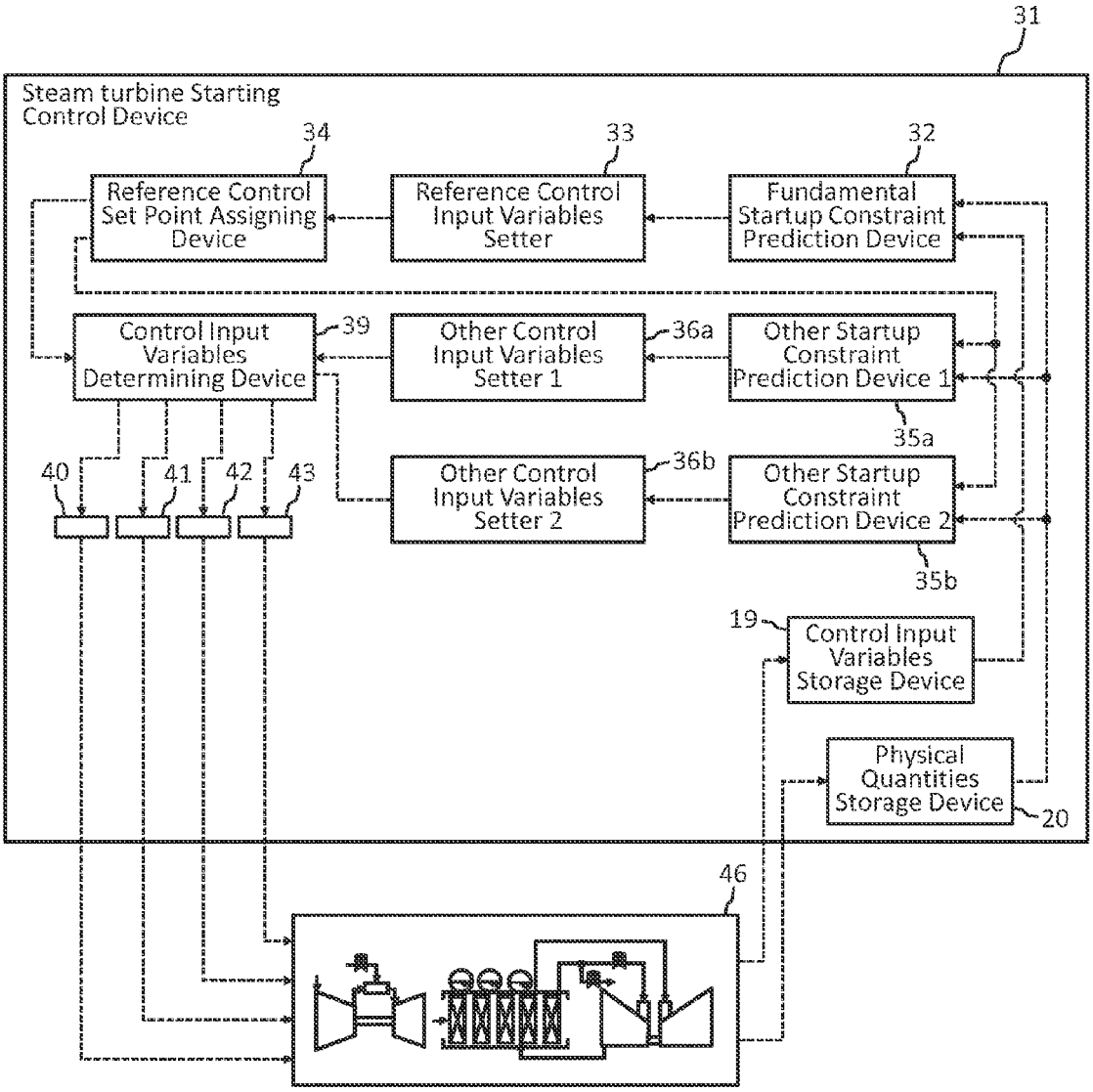
FIG. 6 is a schematic block diagram of a steam turbine power plant according to a third embodiment of the present invention.

FIG. 6 is a schematic block diagram of a steam turbine power plant according to a third embodiment of the present invention. In the figure, substantially the same elements as in the described embodiments are each assigned the same reference number as on the shown drawings, and description of these elements is omitted herein.

The present embodiment differs from the other described embodiments in that the steam turbine starting control device 31 is connected to a plant simulator 46 that simulates steam turbine power plant characteristics, not to a real and actual steam turbine power plant. The steam turbine starting control device 31, although substantially the same as in the first embodiment, may be replaced by the steam turbine starting control device 31 of the second embodiment.

In the present embodiment, the plant simulator 46 exchanges signals with the steam turbine starting control device 31 and samples the command values addressed to the controllers 12, 14 during a startup period calculated by the steam turbine starting control device 31. More specifically, the command values output from the steam turbine starting control device 31 to a virtual controller envisaging the controllers 12, 14, the main steam flow control valve 15, and the bypass valve 16, are input to the plant simulator 46. The plant simulator 46 is a program constructed by combining formulas of thermodynamics, heat transfer, hydromechanics, and the like. A control input variable that the steam turbine starting control device 31 has calculated for the virtual controller equivalent to at least one of the controllers 12, 14 is input, along with at least one of calculated pressure and temperature values of a main steam flow, to the steam turbine starting control device 31. The configuration and control sequence of the steam turbine starting control device 31 are substantially the same as in the first embodiment, except that the control device 31 exchanges signals with the plant simulator 46.

In the present embodiment, time-series data on the thus-calculated command values is stored over a time period from an onset of steam turbine startup to completion thereof, whereby a planned-startup curve for the real and actual steam turbine power plant can be created from the stored data. The real and actual steam turbine power plant can also be operated using a value of the thus-created planned-startup curve as a command value.

(Miscellaneous Qualities and Aspects)

While examples of setting two kinds of other (non-fundamental) startup constraints have been shown and described in the above embodiments, the number of kinds of other startup constraints may be one or at least three. Similarly, while examples of setting one or two kinds of fundamental startup constraints have been shown and described, the number of kinds of fundamental startup constraints may be at least three. The number of fundamental startup constraints and other startup constraints to be classified may be optionally set if a relationship in the length of response time is satisfied.

In addition, although an example of providing the pressure gauge 17 and the temperature gauge 18 has been taken in the description of the devices which measure the physical quantities of the main steam flow, the pressure gauge 17 or the temperature gauge 18 may be omitted if not both of the values measured by these gauges are necessary for the calculation and/or correction of startup constraints in the particular method of calculation.

Furthermore, while a combined-cycle power plant has been taken by way of example, the present invention can be applied to substantially all types of power plants including steam turbines, represented by steam power plants and solar thermal power plants. Sequences to be used to start these power plants are substantially the same as in the embodiments.

For example, when the present invention is applied to a steam power plant, coal or natural gas is equivalent to the heat source, air or oxygen to the low-temperature flow, a fuel control valve to the controller 12, 14, a boiler furnace to the heat source equipment 1, a combustion gas to the high-temperature flow, a boiler heat transfer section (steam-generating section) to the steam generator 2, and a boiler load controller to the reference control input variables setter 33.

For example, when the present invention is applied to a solar thermal power plant, solar light is equivalent, to the heat source, a heat-collecting panel drive to the heat medium flow controller 12, a heat-collecting panel to the heat source equipment 1, a heat-collecting panel direction/angle measuring instrument to the control input variables measuring instrument 11, an oil, a high-temperature solvent salt, or any other appropriate solar-energy conversion and hold medium to the low-temperature flow and the high-temperature flow, an oil flow control valve to the low-temperature flow controller 14, and a collected-heat quantity controller to the reference control input variables setter 33.

Further alternatively, the steam pressure, steam temperature, and fuel flow rate that are entered in a predictive calculation device 32 may only be replaced by steam pressure or steam temperature and a predictive calculation of a thermal stress may be conducted.

Moreover, the plant physical quantities may include a temperature, pressure, flow rate of exit steam as well as those of entrance steam, the steam flowing into the steam turbine 3. Increasing the number of kinds of information about the plant physical quantities allows startup constraint prediction accuracy to be improved. Besides, while the values measured by the control input, variables measuring instruments 11, 13 have been adopted as the control input variables of the controllers 12, 14 that are to be used for the predictive calculation of the startup constraints, those measured values may instead be replaced by the command values that are output to the controllers 12, 14.

What is claimed is:

1. A steam turbine power plant, comprising:

a heat source equipment that heats a low-temperature flow by applying a heat medium and thus generates a high-temperature flow;

a steam generator that generates steam using the high-temperature flow generated by the heat source equipment;

a steam turbine driven by the steam generated by the steam generator;

an electric generator that converts rotational motive power of the steam turbine into electric power;

a controller that controls a plant load; and a steam turbine starting control device that predicts a value of a startup constraint due to a change in physical quantities of the steam in the steam turbine, and controls the controller according to the predicted value;

wherein the steam turbine starting control device includes:

at least one fundamental startup constraint prediction device calculating from a control input variable of the controller a prediction period of fundamental startup constraint data about a fundamental startup constraint which is short in response time with respect to the change in the physical quantities of the steam;

at least one reference control input variables calculating device calculating such a reference control input variable of the controller as the value predicted and calculated by the fundamental startup constraint prediction device will not exceed a corresponding limit value;

at least one other startup constraint prediction device calculating a corresponding prediction period of data about one of other startup constraints longer than the fundamental startup constraint in response time, from the prediction period of reference control input variables data;

at least one other control input variables calculating device calculating such an other control input variable of the controller as the value predicted and calculated by the corresponding other startup constraint prediction device will not exceed a corresponding limit value; and a control signal output device that outputs a command value to the controller according to a value selected from the reference control input variable and the other control input variable.

2. The steam turbine power plant according, to claim 1, wherein:

the controller includes a heat medium flow controller that controls a flow rate of the heat medium supplied to the heat source equipment, and a main steam flow control valve that controls a flow rate of a main flow of the steam supplied to the steam turbine;

the heat medium flow controller is controlled to bring a predicted value of the startup constraint close to a corresponding limit value; and the main steam flow control valve is controlled to bring a current value of the startup constraint close to a corresponding limit value.

3. The power plant according to claim 1, wherein:

a plurality of kinds of startup constraints are selected as those of the other startup constraint; and one set of devices including the other startup constraint prediction device and the other control input variables calculating device are provided for each of the plurality of kinds of startup constraints.

4. The power plant according to claim 3, wherein:

a plurality of kinds of startup constraints are selected as those of the fundamental startup constraint; and one set of devices including the fundamental startup constraint prediction device and the fundamental control input variables calculating device are provided for each of the plurality of kinds of fundamental startup constraints.

5. A planned-startup curve creating system, comprising:

the steam turbine starting control device of claim 1; and a plant simulator that simulates characteristics of the steam turbine power plant, the simulator being further configured to exchange signals with the steam turbine starting control device and sample the command value addressed to the controller during a startup period calculated by the steam turbine starting control device.

* * * * *